United States Patent [19]

Serfozo et al.

[11] 4,055,975

[45] Nov. 1, 1977

[54] PRECISION FORGING OF TITANIUM

[75] Inventors: Tibor Serfozo, Monterey Park; Rod F. Simenz, Studio City, both of Calif.

[73] Assignee: Lockheed Aircraft Corporation, Burbank, Calif.

[21] Appl. No.: 783,607

[22] Filed: Apr. 1, 1977

[51] Int. Cl.[2] ..... B21J 3/00

[52] U.S. Cl. ..... 72/42; 29/DIG. 45; 72/46; 72/352; 72/364; 72/700

[58] Field of Search ..... 29/DIG. 45; 72/41, 42, 72/46, 342, 352, 360, 364, 377, 478, 700; 148/11.5 F

[56] References Cited

U.S. PATENT DOCUMENTS

| | | | |
|---|---|---|---|
| 3,060,564 | 10/1962 | Corral | 72/700 X |
| 3,313,138 | 4/1967 | Spring et al. | 72/364 |
| 3,519,503 | 7/1970 | Moore et al. | 148/11.5 F |
| 3,635,068 | 1/1972 | Watmough et al. | 148/11.5 F |
| 3,691,804 | 9/1972 | Clendenin et al. | 72/42 |
| 3,867,208 | 2/1975 | Grekov et al. | 148/11.5 F |
| 3,969,155 | 7/1976 | McKeighen | 148/11.5 F |

OTHER PUBLICATIONS

Isothermal Hot Die Forging of Complex Parts in a Titanium Alloy, Kulkarni et al., Journal of the Institute of Metals, vol. 100, pp. 146–151 (1972).

*Primary Examiner*—E. M. Combs
*Attorney, Agent, or Firm*—Lowell G. Turner

[57] ABSTRACT

A process of precision forging of titanium or a titanium alloy in which the forging stock and a segmented die are first heated to forging temperature while separated, and are then assembled together and heated again to that temperature, with the stock being covered by a protective coating preferably containing glass grit, and the die sections being coated with lubricant. The heated die and contained heated forging stock are then inserted in a heated holder and the stock subjected to forging force, to partially but not completely deform the stock to the shape of the die cavity, following which the die and stock are separated and the stock allowed to cool, flashing is removed from the stock, the die is cleaned, the die and stock are recoated and then reheated separately and then together, and the stock is forged again to assume more closely the shape of the die cavity. The series of recoating, heating and forging steps are performed at least twice, and may be repeated one or more additional times as necessary to completely forge the part to the die cavity shape.

18 Claims, 4 Drawing Figures

PRECISION FORGING OF TITANIUM

BACKGROUND OF THE INVENTION

This invention relates to improved processes for the precision forgoing of titanium or titanium alloy parts, and to the products produced by such forging.

Conventional methods of forging parts formed of titanium and titanium alloys are extremely expensive and difficult to perform and control, and in most instances produce parts which are not shaped precisely and which require substantial machining to remove large amounts of extra material after the forging process. The most common titanium forging method as currently used in the manufacture of high performance aircraft parts, involves the use of several differently shaped successive dies for each part, with the die cavity in a first of the dies being disigned to deform the titanium forging stock to a first shape defined by the configuration of that particular die, and with the next die being shaped to perform a next successive step in the forging deformation of the stock, and so on, until the final die utlimately gives the forged part a fully deformed shape. The dies employed for this purpose have normally required the parts to be desinged to have substantial draft for enabling their removal from the dies, and as previously indicated, the final product has in most cases been only roughly and not precision formed, necessitating extensive maching and other treatment of the part to give its surfaces accurate shapes required for the intended end use of the part.

There has been disclosed in U.S. Pat. No. 3,635,068 an "iso-thermal" process for forging titanium and titanium alloys, in which process the forging stock and a die structure are heated separtately to a forging temperature, following which the stock is placed in the die, with contained heating if desired, and forging force is applied to the die to deform the stock to a predetermined shape. However, this porcess does not produce what is referred to as a "net" shape, i.e., a finished and usable product. The surfaces of the forged part are not smooth enough to be used "as is," primarily because of lubricant build-up. Also, part distortion is inherent, and therefore it is necessary to "thicken" the walls with additional material which must be removed after forging as by machining.

SUMMARY OF THE INVENTION

A major purpose of the present invention is to provide an improved process for forging parts of titanium or a titanium alloy to precise dimensions not requiring any substantial amount of machining after the forging process (and particularly thin-walled parts), and in a manner enabling such precision forging of parts having zero draft, which ordinarily could not be formed by a conventional forging operation. The process also minimizes or eliminates waste material, and enables a particular part to be formed from a minimum amount of stock. The finish produced on the part by the forging process can be smooth enough and dimensioned precisely enough use of that surface without further treatment, or with a minimum of additional treatment, as for example, the removal of a small amount of flashing from the part.

The process of the invention constitutes an improvement on the above discussed procedure disclosed in U.S. Pat. No. 3,635,068. In performing the present invention, we utilize a segmented zero-draft die, capable of forming parts with surfaces having a no-draft or minimum draft angle (max. 1°) with respect to the main axis of the die. More particularly, where the term "segmented" die is utilized in this application, the term refers to a die having a main body structure which contains the die cavity, and a second die structure which is movable relative to the body structure to perform a forging operation, with the body structure being formed segmentally of two or more parts separable from one another generally transversely of the defined axis of the die assembly. By virtue of their transverse separability, the segments which form the die cavity are able to form surfaces of zero draft angle with respect to the die axis, that is, surfaces which can extend directly parallel to that axis.

In performing a process embodying the invention, the segmented die and forging stock are first heated to approximately the forging temperature for the stock while separated from one another, the stock is then placed in the segmented die with the stock having a protective coating and the die being coated with lubricant, the assembled parts are then further heated, the die containing the stock is placed in a heated holder, and forging force is applied to the die in a manner to deform the stock partially but not completely to the shape of the die cavity, following which the segmented die is disassembled and the stock removed therefrom, and the steps of separate heating, combined heating, forging, and so forth, are repeated to forge the stock further toward the shape of the cavity. If necessary, the steps are repeated again until ultimately the stock is shaped precisely to the configuration of the cavity and can be removed therefrom by virtue of the segmented character of the die. Desirably, the die holder is preheated to and maintained at a temperature considerably above ambient temperature but not as high as that of the die and stock themselves.

BRIEF DESCRIPTION OF THE DRAWING

The above and other features and objects of the invention will be better understood from the following detailed description of a typical embodiment as illustrated in the accompanying drawing, in which.

DESCRIPTION OF THE PREFERRED EMBODIMENT

Figure 1:
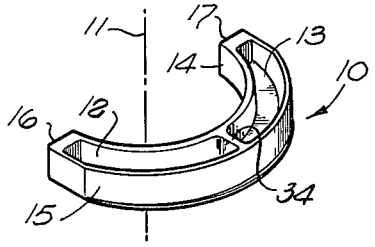
FIG. 1 is a perspective view of a typical thin-walled titanium alloy part which has been forged by the process of the invention.

The part 10 typically illustrated in FIG. 1 is an aircraft tail bumper structure which has been very successfully forged from titanium alloy by a process embodying the present invention, and which has shape characteristics rendering it extremely difficult to form by conventional methods. The part is shaped essentially arcuately about an axis 11, has relatively deep arcuate pockets 12 and 13 formed in its upper side, and has vertical arcuate inner and outer surfaces 14 and 15 and opposite end surfaces 16 and 17 all of which may be parallel to axis 11 and thus have zero draft with respect to a die whose parts are movable relative to one another that axis.

Figure 2:
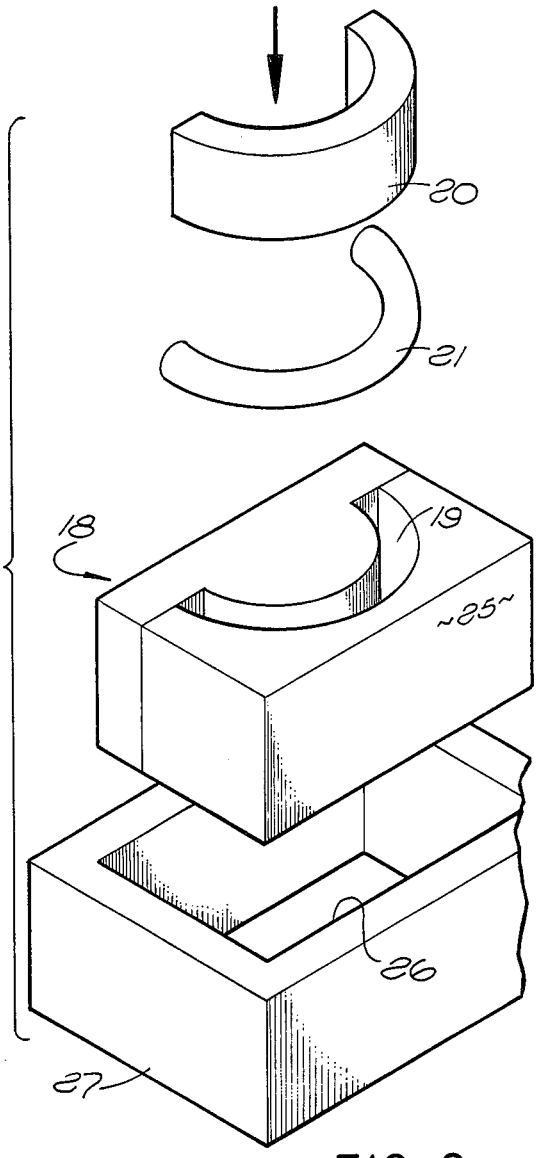
FIG. 2 illustrates in exploded perspective form the titanium alloy stock, segmented die, and die holder which may be utilized in forming the part of FIG. 1.

The segmented zero-draft forging die for producing the part 10 of FIG. 1 is illustrated in FIG. 2, and includes a main die body structure 18 containing an arcuate die cavity 19 within which an upper die section 20 is movably received, to act against an appropriately shaped piece of titanium or titanium alloy stock 21. the stock 21 is shaped to fit within cavity 19, and is constructed to have a volume corresponding substantially to or very slightly greater than the volume of part 10. In this instance, the stock 21 may be formed from an initially straight cylindrical titanium or titanium alloy rod, cut to the proper length and then bent to an arcuate curvature corresponding essentially to that of cavity 19. For forming some parts, a square bar stock can be used.

Figure 3:
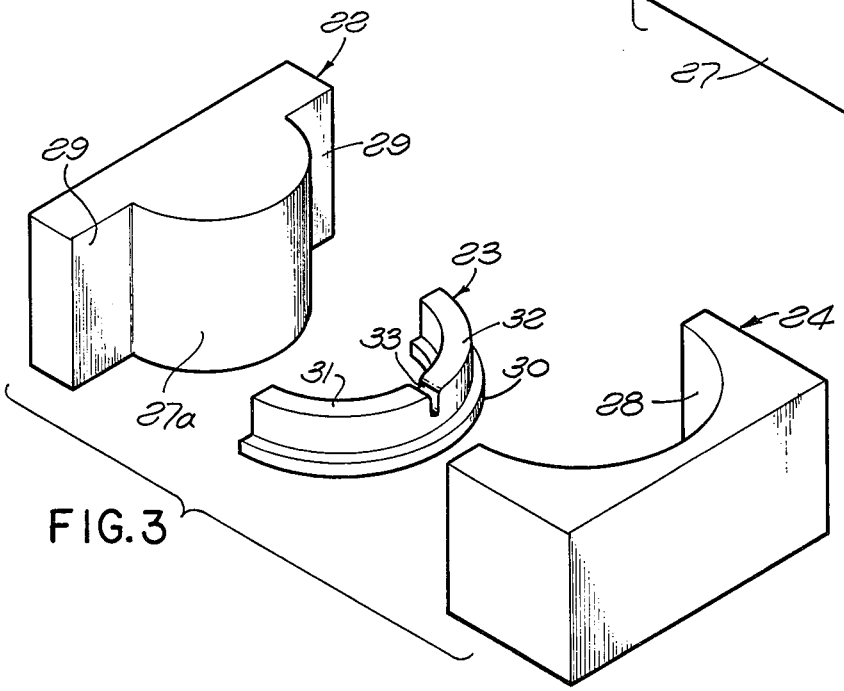
FIG. 3 shows in exploded perspective form the main segmentally formed body of the die and the top and bottom punches.

The main body 18 of the die is formed segmentally of a number of parts, typically three as illustrated at 22, 23, and 24 in FIG. 3, which elements fit together in a manner forming between them the cavity 19 of the desired shape, with the assembled structure 18 being shaped externally as a block of essentially square horizontal section, having mutually perpendicular vertical outer side faces 25 which fit closely within a recess 26 of corresponding horizontal cross section in a rigid metal die holder 27. When the body structure 18 is received within opening 26 in holder 27, the various segments 22, 23, and 24 of structure 18 are held tightly together in a manner preventing displacement thereof by the forging forces exerted against the stock 21.

Figure 4:
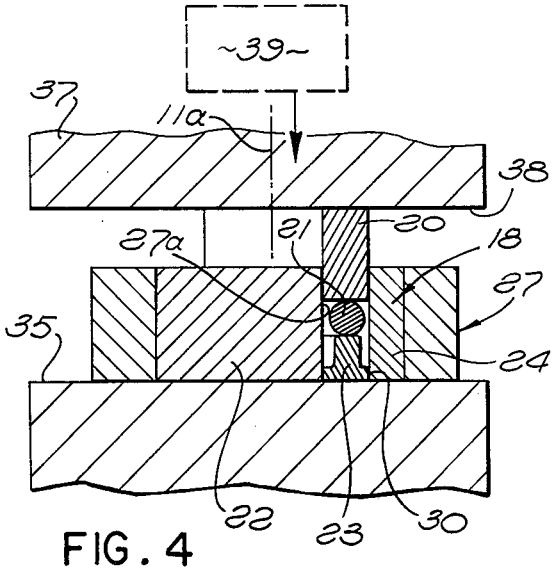
FIG. 4 illustrates a forging step of the process.

As shown in FIG. 4, the actual forging operation is performed by movement of the upper die section 20 downwardly relative to the main die body structure 18 along a vertical axis 11*a*. The segments 22 and 24 of die body structure 18 have opposed essentially arcuate vertical surfaces 27*a* and 28 (FIGS. 3 and 4), both of which may be parallel to axis 11*a* and thus have zero draft with respect to that axis. The opposite ends of the cavity 19 formed between surfaces 27*a* and 28 may be closed by vertical surfaces 29 of die segment 22, which surfaces 29 like the surfaces 27*a* and 28 may also extend parallel to axis 11*a* and have zero draft angle. The bottom of cavity 19 may be closed by the third segment 23 of the die body structure 18, which segment 23 may be shaped essentially arcuately and have lower portions 30 which engage lower portions of surfaces 27*a*, 28 and 29 continuously entirely about the segment 23, to prevent escape of any of the forging stock 21 downwardly past part 23, while the upper portion of segment 23 is shaped to provide arcuate projections 31 and 32 for forming recesses 12 and 13 in part 10, with a cutaway region 33 in segment 23 for forming a partition 34 in the forged part 10.

The stock from which the part being forged is produced may be either commmercially pure titanium, or any known or appropriate titanium alloy having a composition permitting it to be shaped by forging. For example, the stock may be any forgable alpha alloy of titanium, such as Ti-5Al-2½Sn, or any appropriate forgeable beta alloy such as Ti-10V-2Fe-3Al, or any appropriate forgeable alpha-beta titanium alloy, such as Ti-6Al-4V. Without attempting to enumerate all possible alloys which may be employed, other typical usable alloys are Ti-8Al-1Mo-1V and Ti-6Al-6V-2Sn.

Each such alloy has a known optimum forging temperature within the range between about 1200° F. and 1950° F. As an example, Ti-6Al-4V has an optimum forging temperature between about 1700 and 1750° F. Before the actual forging step, the stock is heated to approximately this optimum temperature for the particular alloy or pure titanium being employed, so that the stock will deform in a most effective manner under the forging force. The stock is heated while separated from and out of contact with the die parts, and before being heated is coated on all surfaces with a layer of protective materail capable of preventing oxidation of the stock and also serving as a lubricant during the forging step. The coating substance is of course selected to withstand the ultimate forging temperature to be attained, and may be any conventional coating for this purpose, preferably glass grit, consisting of finely divided glass particles in a liquid carrier.

All of the parts of the die are also preheated to the defined forging temperature, while separated from the stock. In the arrangement illustrated in the drawing, part 20 and die body segments 22, 23 and 24 would all be heated in this manner. The heating of both the die parts and the stock may be performed in a gas furnace or in an electric furnace, or may be performed by placing the parts within an induction coil.

The die parts 18, 22, 23, and 24 must be formed of a material which will retain its strength and rigidity when heated to the forging temperature, which can withstand the forging forces exerted thereagainst during forging, and which will not corrode, oxidize, deform or otherwise deteriorate under repeated heating and cooling, and repeated application and release of forging force to the die assembly. Any appropriate metal having these characteristics may be selected for the purpose, such as an appropriate known nickel base super alloy. Typical examples of die materials which may be employed are the alloys sold under the trade identification "IN-100" by International Nickel Co. and the alloy sold under the trade name Udimet-700 by Special Metal Corp.

At the same time that the stock is being heated to, or approximately to forging temperature, all of the die parts are similarly being heated to, or approximately to the same forging temperature, but with the die parts being out of contact with the stock and preferably also out of contact with one another. The die parts are coated with a forging lubricant capable of withstanding the high forging temperatures, with this coating material desirably being sprayed onto the parts while they are separated from one another and from the stock, and in a manner to continuously coat all of the surfaces of the die parts. Any suitable commercially available or conventional high temperature forging lubricant may be employed for the purpose, such as graphite contained within a suitable liquid carrier which can withstand the forging temperature. For best results, the lubricant is sprayed onto the die parts after they have attained the forging temperature.

When both the stock and the segmented die structure have been heated to approximately the forging temperature while these parts are all separated from one another, the segments of the main body of the die are assembled together in the manner illustrated at 18 in FIG. 2, the heated stock 21 is positioned in the cavity in that assembly, and the upper section 20 of the die is placed in the cavity above the stock. These parts are then all heated together to maintain the forging temperature, or to reattain that temperatre if they have cooled slightly during the assembly process, and are then placed as a unit into holder 27*a*. Prior to such placement of the die and stock in holder 27*a*, the holder is preheated to a temperature several hundred degrees above ambient temperature, desirably between about 700° and 800° Fahrenheit, and for best results about 700° Fahrenheit. This temperature to which the holder is preheated, while far above ambient temperature, is still well below the forging temperature to which the die and stock parts have been heated.

At the time that the die assembly and contained stock are positioned in holder 27, the holder may be supported by the upper horizontal surface 35 of a lower platen 36 of a forging press, whose upper platen or head 37 having a horizontal undersurface 38 is adapted to be forcibly actuated downwardly by a hydraulic actuating ram or other power source to press under die part 20 downwardly relative to lower die assembly 18 and against the stock 21 (FIG. 4). The actuating hydraulic ram (diagrammatically represented at 39 in FIG. 4) exerts the downward force relatively gradually, and over a substantial though short interval of time, rather than as an instantaneous striking force in the manner of a drop forge mechanism. This slower application of force to the die assembly is necessary in order to accomplish satisfactory deformation of the titanium or titanium based alloy stock.

The downward forging movement of the hydraulically actuated press head 37 and the contacted die part 20 is continued through a long enough stroke to deform the stock 21 partially toward the shape of the die cavity, but not completely to that shape. After this initial partial forging step, head 37 is retracted upwardly, and the die assembly is removed from holder 27*a*, following which, all of the parts of the segmented zero draft die 18 are separated from one another and the partially forged stock is removed therefrom. When the partially forged stock has cooled, any small flashing which may be presented on the part is removed as by sawing and grinding, and any small surface defect is removed by grinding.

The segmented die parts 20, 22, 23, and 24 are separately cleaned as by sand blasting or vapor honing to remove any coating or any other material remaining thereon, preferably without being cooled.

The partially forged stock is again coated with its protective layer of glass grit or the like, and the stock and die parts are then reheated to, or approximately to the forging temperature while separated from one another, at which temperature the die parts are separately coated with graphite lubricant or the like, the die is reassembled with the stock therein, and the assembly is heated again to maintain or retain the forging temperature.

The assembly at this temperature is placed again in the holder 27, which has been preheated to the discussed temperature several hundred degrees above ambient temperature but well below the forging temperature of the stock and die, and forging force is again applied to the die and stock as illustrated in FIG. 4. This second forging step deforms the stock further toward the shape of the cavity within which it is confined, and if possible, the forging is completed by the second step to give the stock precisely the shape of the cavity, as illustrated in FIG. 1. When this condition is attained, the die parts and stock are removed from the holder, separated, and cooled, with the segmental construction of lower die assembly 18 permitting the parts 22 and 24 to be moved laterally away from the formed titanium part, transversely of axis 11*a*, to release it from the die even though the outer surfaces of the formed part 10 have zero draft with respect to that axis.

In many instances, more than two forging operations will be required, in which case the die and stock parts are removed from holder 27 after the second forging step, the stock and die parts separated, and the stock allowed to cool, with all of these parts then being cleaned, and any small amount of flashing on part 21 being removed. The part 21 is then recoated and reheated, the die and stock parts are reheated while separated from one another, the die parts are sprayed and then assembled together and with the stock, and placed in a preheated, lower temperature holder, for a third pressing operation. This same series of steps is repeated as many times as necessary to ultimately arrive at the desired shape for part 10 corresponding exactly to the shape of the cavity within the die assembly.

The following is given as a typical example of a specific forging process which has been performed successfully in accordance with the invention.

EXAMPLE 1

An aircraft part having the configuration illustrated in FIG. 1 was forged from Ti-6Al-4V titanium based forging alloy, using a die assembly and holder of the type illustrated in FIG. 2. The titanium alloy was cut from an initially straight cylindrical rod of such material, which was cut to have a volume just slightly greater than the volume of the part to be formed, and was bent to the curved shape illustrated in FIG. 2 corresponding essentially to the arcuate shape of die recess 19. In this condition, the rod 21 was dimensioned to fit downwardly into the die recess. The stock 21 was coated with a commerically available liquid glass (glass grit) sold under the trademark DELTA GLAZE 23 by Acheson Colloids Co. This grit was applied to the stock by brush, and covered all surfaces of the stock. The coated stock was heated in an electric furnace to a temperature of 1700° F., and the die parts 20, 22, 23 and 24 were all similarly heated in an electric furnace to a temperature of 1700° F., while separated from one another and out of contact with one another and with the stock. After the die parts reached 1700° F., a high temperature forging lubricant including graphite in a liquid carrier, sold under the trademark WO 482 by Acheson Colloids Co. was sprayed onto the die parts to coat all of the surfaces of those die parts continuously while the parts were still separated from one another. The heated die parts 22, 23 and 24 were then assembled together to the condition illustrated in FIG. 2, the heated stock 21 was placed in cavity 19, and the heated upper die part 20 was placed in the cavity above the stock. This entire die and stock assembly was again heated in an electric furnace to the predetermined forging temperature of 1700° F., and the heated assembly was then placed in holder 27 which was formed of steel and was preheated to a temperature of 700° F. Forging force was applied by a hydraulic ram as illustrated in FIG. 4, to partially but not completely forge the stock to the shape of the die. The pressure exerted by the press was initially 15 tons per square inch, and was gradually increased to 30 tons per square inch, which pressure was maintained for a dwell interval of about 2 minutes. This produced a relatively slow movement of the head 37 and a relatively slow flow of material in the die.

The die and partially deformed stock were removed from holder 27 and the stock cooled, and a small amount of flashing which had formed on stock 21 was ground way. The die parts and stock were cleaned and all surface material removed therefrom, following which the partially forged stock was recoated with the discussed liquid glass, and the steps of reheating the die and parts separately, spraying lubricant onto the die parts while separate, assemblying the heated parts together, reheating them while assembled, placing them in the preheated but lower temperature holder 27, and exerting relatively slow forging force against the die by head 37 were all repeated. The second such series of steps completed the forging process and deformed the stock to exactly the shape of the die cavity. The parts were then removed from the die and separated and cooled, flashing was again ground from the part, and the ultimate product as shown at 10 in FIG. 1 resulted. This part had a smooth surface finish, and was well formed and shaped though of zero draft configuration.

While a certain specific embodiment of the present invention has been disclosed as typical, the invention is of course not limited to this particular form, but rather is applicable broadly to all such variations as fall within the scope of the appended claims.

We claim:

1. The titanium forging process that comprises:

preparing a quantity of titanium or titanium alloy stock shaped to fit within a cavity in a segmented zero draft die and having a volume approximately equal to that of a forged part to be manufactured in the die;

applying a protective coating to said stock;

heating said coated stock and said segmented zero draft die while separted to approximately a predetermined optimum forging temperature for said stock at least as high as about 1200° F;

coating all segments of said die with a lubricant before positioning the stock therein;

positioning the heated stock in the heated die;

heating the die and contained stock further after assembly together and as necessary to give the combination said forging temperature;

applying forging force to said heated segmented die to deform the heated stock partially, but not completely, toward the shape of said cavity;

separating the sections of said segmented die and removing the partially forged stock therefrom;

applying a protective coating again to said partially forged stock;

reheating said partially forged stock and said segmented die while separated to said forging temperature;

coating said die segments again with a lubricant before placing the stock therein for a second time;

repositioning said heated partially forged stock in the segmented die;

reheating the die and stock together;

applying forging force again to the heated die to further deform the heated partially forged stock toward the shape of said cavity; and separating the die sections and removing the forged stock therefrom.

2. The titanium forging process as recited in claim 1, including placing the heated die and contained stock within a holder prior to the initial application of forging force to the die, and prior to the second application of forging force to the die; and maintaining the sections of said segmented die in assembled condition by said holder during each of said applications of forging force to the die.

3. The titanium forging process as recited in claim 1, including placing the heated die and contained heated stock together in a holder before the initial application of forging force to the die, and before the second application of forging force to the die; and preheating said holder, before each placement of the die and stock therein, to a temperature far above ambient temperature but less than the temperature of the die and stock.

4. The titanium forging process as recited in claim 1, in which said second application of forging force to the heated die is continued until the heated previously partially forged stock is completely forged to the shape of the die cavity.

5. The titanium forging process as recited in claim 1, in which said second application of forging force to the die does not deform the stock completely to the shape of said cavity; said process including further deforming the partially forged stock, ultimately to a shape corresponding substantially exactly to that of the die cavity, by repeating at least one additional time, and more times if necessary, the steps of applying a protective coating to the partially forged stock, reheating the partially forged stock and segmented die separately to approximately forging temperature, repositioning the heated partially forged stock in the heated segmented die coated with a lubricant, reheating the die and stock together, applying forging force again to the heated die to further deform the heated partially forged stock toward the shape of the cavity, and separating the die sections and removing the forged stock therefrom.

6. The titanium forging process as recited in claim 1, in which said lubricant with which the die is coated before each placement of the stock therein is a graphite suspension.

7. The titanium forging process as recited in claim 1, in which said protective coating which is applied to the stock before each heating step is a liquid containing glass grit and adapted to protect the stock against oxidation when heated to said forging temperature.

8. The titanium forging process as recited in claim 1, in which said cavity in the segmented die has no-draft surfaces and forms corresponding no-draft surfaces on the forged stock from which the die is separable by virtue of its segmented construction.

9. The titanium forging process as recited in claim 1, in which said forging temperature to which the stock and die are heated is between about 1200° and 1950° F.

10. The titanium forging process as recited in claim 1, in which said forging temperature to which the stock and die are heated is between about 1700° and 1750° F.

11. The titanium forging process as recited in claim 1, including removing flashing from the partially forged stock after the first forging step and before said reheating of the stock and die.

12. The titanium forging process as recited in claim 1, including cleaning said lubricant from the sections of the segmented die after the first application of forging force thereto and after removal of the stock thereform, and recoating the die sections with lubricant before repositioning the stock and the die for the second application of forging force thereto.

13. A precision forged product of titanium or titanium alloy manufactured by the process recited in claim 1.

14. A precision forged product of titanium or titanium alloy manufactured by the process recited in claim 3.

15. A precision forged product of titanium or titanium alloy manufactured by the product recited in claim 5.

16. The titanium forging process that comprises:

preparing a quantity of titanium or titanium alloy stock shaped to fit within a cavity in a segmented die and having a volume approximately equal to that of a forged part to be manufactured in the die;

coating all of the surfaces of said stock with a layer of material including glass grit in a liquid carrier, which material is capable of protecting said surfaces of the stock against oxidation when heated to the forging temperature of the stock;

heating said coated stock and said segmented die while separate to appoximately the forging temperature of the stock;

coating the heated die with a graphite suspension lubricant;

positioning the heated stock in the heated die;

heating the die and contained stock together to said forging temperature;

preheating a die holder to a temperature several hundred degrees above ambient temperature but much lower than the temperature of the stock and segmented die;

then placing the heated die and the contained stock together in said holder;

applying forging force to said heated segmented die in said holder to deform the stock partially, but not completely toward the shape of said cavity;

removing the die and stock from the holder and separating the sections of the segmented die and removing the partially forged stock therefrom;

allowing the stock to cool;

removing flashing from the stock;

applying a second coating of heat resistant glass grit in a liquid carrier to the srufaces of said partially forged stock;

cleaning the surfaces of the sections of the segmented die;

reheating the partially forged coated stock and the segmented die while separate to essentially said forging temperature;

recoating the heated sections of the segmented die with graphite suspension lubricant;

repositioning the partially forged stock in the segmented die;

reheating the die and contained stock together;

placing the die and stock together in said holder while the latter is at a temperature several hundred degrees above ambient but much lower than the temperature of the die and stock;

applying forging force again to the die while in said holder to further deform the stock toward the shape of said cavity; and removing the die sections and forged stock from the holder and separating the die sections from the stock.

17. The titanium forging process as recited in claim 16, including further deforming said stock, ultimately to a shape corresponding closely to the shape of said die cavity, by repeating at least one additional time, and more times if necessary, the steps of cleaning the die sections, removing flashing from the partially forged stock, applying a protective coating to the stock, heating the stock and die sections while separate to forging temperatures, positioning the reheated stock in the die, heating the die and contained stock together, placing the die and stock in the holder with the latter at a temperature above ambient temperature but less than that of the die and stock, applying forging force to the die to deform the stock further toward the shape of said cavity, and removing the die and forged stock from the holder and separating the die sections from the stock.

18. A forged titanium or titanium alloy product manufactured by the process recited in claim 17.

* * * * *